United States Patent [19]

Farquharson

[11] 4,404,690

[45] Sep. 20, 1983

[54] HOCKEY HELMET

[75] Inventor: Charles R. Farquharson, Toronto, Canada

[73] Assignee: Amer Sport International Inc., Lachine, Canada

[21] Appl. No.: 295,219

[22] Filed: Aug. 21, 1981

[51] Int. Cl.[3] ..... A42B 3/00

[52] U.S. Cl. ..... 2/420; 2/425

[58] Field of Search ..... 2/420, 425, 417, 418, 2/419, 6, 410

[56] References Cited

U.S. PATENT DOCUMENTS

| | | | |
|---|---|---|---|
| 3,629,864 | 9/1971 | Latina | 2/420 |
| 3,665,514 | 5/1972 | Durand | 2/420 |
| 3,820,163 | 6/1974 | Rappleyea | 2/420 |
| 3,925,821 | 12/1975 | Lewicki | 2/425 |

FOREIGN PATENT DOCUMENTS

| | | | |
|---|---|---|---|
| 1116801 | 1/1982 | Canada | 2/425 |

*Primary Examiner*—Peter P. Nerbun

*Attorney, Agent, or Firm*—Donald E. Hewson

[57] ABSTRACT

A hockey helmet is provided, which comprises a plurality of pieces joined together in such a manner that the helmet is adjustable over a wide range of sizes. A pair of side pieces is provided, to which are attached a front and back piece, and over which a top piece is secured. The helmet is adjustable in length, width and height, to accommodate various sized heads. A plurality of structural ribs are formed in the helmet to distribute and absorb forces, and a force absorbing liner is provided within the helmet. A plurality of ventilation openings are included, to keep the inside of the helmet cool.

26 Claims, 9 Drawing Figures

HOCKEY HELMET

FIELD OF THE INVENTION

This invention relates to helmets, particularly to helmets intended for use by athletes; and specifically, this invention relates to helmets which are adjustable in size and which are intended to be worn by hockey players of all sizes and ages. The present invention, therefore, is directed tp persons, both children and adults, male and female, who may play hockey either for recreation or as a profession. In addition, helmets according to the present invention may also be worn by other athletes, particularly such as lacrosse players, and as well by cyclists, boxers and the like, or by motorcycle riders; or such helmets may also be worn by persons in the military, e.g., airplane pilots or crew.

BACKGROUND OF THE INVENTION

As noted, helmets according to the present invention may find considerably wider use than simply by hockey players (or lacrosse players, who tend to use much the same protective equipment for their hands, arms and upper torso, and heads, as hockey players). However, this discussion is directed towards the present invention and its particular adaptability for use as a hockey helmet, having regard to the nature of that game as opposed, say, to American football; and having further regard to the safety standards which such helmets must pass before being permitted to be marketed or used in organized hockey leagues.

Several particular features of helmets according to the present invention distinguish them from helmets such as those worn by persons who are playing American (or Canadian) football. Football helmets generally tend to be quite smooth in configuration, and heavily padded in their interior. This is because the helmet is not only worn for protection against head injuries, the player may sometime use it somewhat as a battering ram; and in any event, the player is more subject to disruptive and sudden head movements due to the body contact nature of that game, than is a hockey player. Moreover, football players have bare hands, and very often have the duty of stopping a player from the opposing team by grasping or blocking that player using their hands or bodies. Such is not the case, however, with hockey or lacrosse, in particular. Moreover, football players tend very often to take their helmets off between plays, or when they go to the sidelines; whereas hockey players (and lacross players) do not because they wear bulky gloves and carry a stick in one or both hands. Thus, it is of considerably greater importance that a hockey helmet be properly ventilated, so as to keep the head cool, and to promote faster evaporation of perspiration from around the head.

The other major distinction between hockey helmets and ordinary football helmets, and a principal feature of this invention as compared with previous hockey helmets, is the matter of adjustability. That is, helmets according to the present invention can be more specifically fitted to a variety of sizes—and indeed shapes—of heads, using the same standard components which may be mass-produced in quantity. In other words, helmets according to the present invention may be produced from the same molds and all have the same sizes of individual pieces, but be sufficiently adjustable as to accommodate the head of a young person who is just learning to play hockey as well as the head of a professional hockey player or other adult.

In general, hockey equipment, even for young players—and especially helmets—tends to be individually owned rather than supplied by a team for use during a game or during a specific series of plays in a game. Thus, each individual tends to want to adjust a hockey helmet which he will wear during the entire duration of a game, and throughout the season and perhaps from season to season, so that it is most comfortable on him. However, such adjustability has not generally been practicable nor even possible in previous hockey helmets.

It is generally recognized that the human head is elliptoid; that is, the head gets longer in length from front to back, as it gets wider from side to side and higher, particularly in the crown portion above the ears. Also, it is the purpose for hockey helmets to preclude serious head injuries, which are not generally due to the impact of the shell of the helmet on the skull—at which time the liner of the helmet has substantially totally compressed—and to preclude any substantial impact of the brain on the interior of the skull. The brain is surrounded by a viscous fluid which acts somewhat as a shock absorber, but if an impact force of sufficient magnitude is transmitted to the skull such that the brain moves to the extent that it collides with the interior of the skull, concussion or other serious brain damage can occur.

Thus, a principal concern, and a measure of the acceptability of hockey helmets for entry to the market and use in organized hockey leagues of all types, is the ability of a hockey helmet to absorb specific forces. Those standards are generally such as those which have been set forth by the Canadian Standards Association standard for hockey helmets, namely publication No. Z262.1-1975, and are generally internationally accepted. The forces which a hockey helmet must withstand are generally those which are sufficient to cause concussion, and may not necessarily be below the limit which would cause a minor bump or bruise to the outer surface of the skull.

As to the matter of ventilation, it is not only important that there be free space within the interior of the helmet to permit evaporation of perspiration, the free space should be channeled or connected to other areas of free space to permit air flow. Moreover, the helmet should be well ventilated to the exterior so as to permit airflow in and out of the helmet, and to promote cooling and to carry off moist and warm air from within the helmet to the outside. However, it is important to note that the liner within a helmet should contact the skull in all of the correct places, and particularly in the centre of the top of the helmet, the centre of the back of the helmet, and the centre of each side of the helmet.

Still further, the design of the helmet must be such that the shell will distribute the force of impact, and absorb some of the force of impact due to the springiness of the ribs that are formed within the helmet as discussed hereafter; and the liner must absorb the remaining force of impact without transmitting that impact force to the skull beneath it. Thus, where the liner is secured to the shell by way of rivets or bolts, or where the shell pieces are secured one to another by way of nuts or bolts for purposes of adjustment, all of those rivets or bolts must be located in places where they are least likely to receive or transmit a force of impact directly to the skull. Thus, the liner which is placed within the shell must contact the skull in areas between the ribs which are formed in the shell, so as to provide the requisite shock absorption, and to assure that the helmet fits to the head after proper adjustment.

DISCUSSION OF THE PRIOR ART

Several patents of note, each of which refers to helmets known in the prior art—although not all are hockey helmets—are discussed briefly hereafter, with reference to the problems inherent in such helmets and the manner by which a helmet according to the present invention overcomes those problems or distinguishes over the prior art helmets.

One of the earlier hockey helmets is that which is described in Canadian Pat. No. 706,563, issued Mar. 30, 1965, to CHILD. That helmet merely provides two co-operating sections, which are adjustable with respect one to other by way of a pair of fastening means at each side of the helmet, passed through each of a pair of slots in one of the sections and through one each of a pair of slots in one of the sections and through one slot in the other of the sections, so that adjustment is possible by changing the effective longitudinal cross-section of the helmet. However, the helmet leaves great areas of the skull exposed, through which the blade of a hockey stick or the tip of skates might pass, and it leaves the lower portion of the back of the skull substantially exposed and unprotected.

Another Canadian Pat. No. 730,337, issued Mar. 22, 1966, to SHAW, teaches a patent which has two sections, one of which covers the top and rear portions of the head, the other of which covers the forehead portion of the head. However, a substantial area of the head above the forehead is left open. Ribs are incorporated in the helmet at the rear and top portions thereof, to absorb and deflect the force of impact.

TURNER ET AL, in U.S. Pat. No. 2,634,415, issued Apr. 14, 1953, teach a football helmet which is quite heavy, being very thickly padded on its interior, and having a number of ventilating holes extending to the exterior of the helmet. However, with minor exceptions, there is no provision made for circulation of air within the helmet, and none for adjustability.

LATINA, in U.S. Pat. No. 3,629,864, issued Dec. 28, 1971, teaches a hockey helmet which provides for adjustment to various head sizes by varying the connection points of a crownpiece to a back piece. A plurality of holes are provided on the back of the back piece and on each side thereof, so that the head cavity may be enlarged lengthwise and heightwise—but not in width. A number of very large gaps are left in the helmet, through which a hockey stick or skate might extend.

One further prior art patent is that issued to O'CONNOR, U.S. Pat. No. 3,783,450, dated Jan. 8, 1974. That hockey helmet has a single piece outer shell, with a number of ribs formed lengthwise of the shell, and a number of openings formed in the ribs so that they provide air passages within the shell for cooling. However, the only way that the O'Connor helmet can be made to accommodate different sizes of heads is to insert different thicknesses of pads into the single piece shell. Thus, warehousing and inventory of such helmets must be sufficient to accommodate all different size requirements; and moreover, as a child grows to an adult, he may constantly be required to replace his helmet with one which is larger because of the inability to otherwise adjust the helmet which he has been wearing.

However, helmets according to the present invention overcome the difficulties enumerated above, by providing for adjustment not only in length but in height and width; and by providing sufficient space for air flow within the helmet and from the interior of the helmet to the exterior thereof, whether the wearer is stationary or is moving during the play of a game.

Moreover, the present invention provides a helmet which leaves no essential area of the skull of the wearer exposed, especially at the back of the head at the nape of the neck, and in the temple areas. Still further, the present invention provides a helmet which overcomes the difficulties of most two piece hockey helmets—apart from very limited adjustability in height or in width—and that is that most two piece helmets have a parting line diagonally across the head so that as they are adjusted to accommodate larger heads, a gap is left behind the ear or over the ear, through which a hockey stick or skate might intrude and cause severe injury to the skull.

Moreover, it has been determined that helmets which comprise three pieces will not normally overcome all of the above problems; because if the helmet is designed to split behind the ear, the ear opening moves forward for larger sizes which puts pressure on the ear; or if the helmet splits in front of the temple, the temple protector must move backward when adjusted, which would then expose part of the temple; or if the helmit splits over the ear opening, the ear opening would become too wide, thus leaving part of the head unprotected.

As a practical matter, it must be considered that if a helmet is to adjust to fit, say, North American head sizes from 6.5 to 8, this requires that the hat band circumference of the helmet must range from about 20.5 inches to more than 25 inches. Thus, the more adjustment places there are around the circumference of a helmet, the less amount of adjustment is required at each place. For example, a two piece helmet may require adjustments of more than 2.5 at each side, if a single helmet is to accommodate the entire size range mentioned above. Likewise, a three piece helmet or a two piece helmet having a crown also requires a very wide range of adjustment accommodation. (See, for example, LATINA, U.S. Pat. No. 3,629,864, referred to above.)

Moreover, even if four piece helmets are considered, such as by the provision of a top piece, a front piece and two side pieces with a seam at the centre back, any adjustment results in twice as much increase in width at the front of the helmet than at the back of the helmet.

When the helmet has five pieces, as in the present invention, the circumference of the helmet can be split at the temple on each side and behind the ear on each side, with the top being capable of moving essentially straight up with reference to the sides, so that each adjustment around the circumference of the helmet needs only to be slightly greater than 1 inch to accommodate the entire size range mentioned above. Still further, there is no requirement for different liners or additional padding or pegs such as have been provided in the past to adjust helmets to different sized heads, so that manufacture and inventory of a single helmet having five pieces, with identical liner pieces for all, will accommodate the full range of head sizes intended.

Thus, the present invention provides a five piece helmet which comprises a pair of side pieces, a top piece, a front piece, and a back piece. Each of the side pieces has forward, upper and rear portions, the side pieces being adapted to generally accommodate each side, respectively of a human head. The top piece is generally downwardly concave and has forward, rear and side portions, each of which has a lower portion; the top piece being adapted to generally accommodate at least the upper portion of a human head. The front piece is generally rearwardly curved, and is adapted to accommodate at least the forehead portion of a human head; the front piece having an upper portion, and a rear portion at each side thereof. The back piece is generally forwardly curved and is adapted to accommodate the rear portion of a human head. The back piece has an upper portion, and a forward portion at each side thereof. The front and back pieces are secured at their respective rear and forward portions to the respective forward and rear portions of each of the pair of side pieces; and the top piece is secured at least to both side pieces at their respective upper portions.

In a preferred embodiment, as discussed hereafter, the top portion is secured to the side portions and to the upper rear portions of the front piece at each side and the upper front portions of the back piece at each side.

The adjustability of the helmet is particularly provided by slots which are formed in the front and back pieces and the top piece, so that they may move forwardly, rearwardly and upwardly, respectively, with respect to the side pieces. Moreover, the slots are generally formed where there is curvature, so that adjustment forwardly or rearwardly of the front or back pieces, respectively, or upwardly of the top piece, is accompanied by an accompanying relative movement of the side pieces outward one from the other; so as to accommodate extra width as the length and height of the helmet are increased.

BRIEF SUMMARY OF THE INVENTION

It is a purpose, therefore, of the present invention to provide an adjustable helmet, in particular a hockey helmet but which may be worn for other purposes, and which is adjustable in length, width and height, to accommodate a wide range of human head sizes.

A further purpose of this invention is to provide such a helmet as discussed above, where the same liner pieces can be used in the helmet for all sizes of head to be accommodated by it.

Yet a further object of this invention is to provide a helmet that gives good ventilation, while protecting the head of the wearer.

A principle feature of the present invention is the fact that the helmet may be easily and relatively inexpensively manufactured and assembled.

Another object of this invention is to provide a helmet where different ear sling or jaw protection pieces may be provided, without otherwise affecting the function or adjustability of the helmet.

BRIEF DESCRIPTION OF THE DRAWINGS

These and other features and objects of the present invention are more fully discussed hereafter, in association with the accompanying drawings, in which.

DESCRIPTION OF THE PREFERRED EMBODIMENTS

Figure 1:
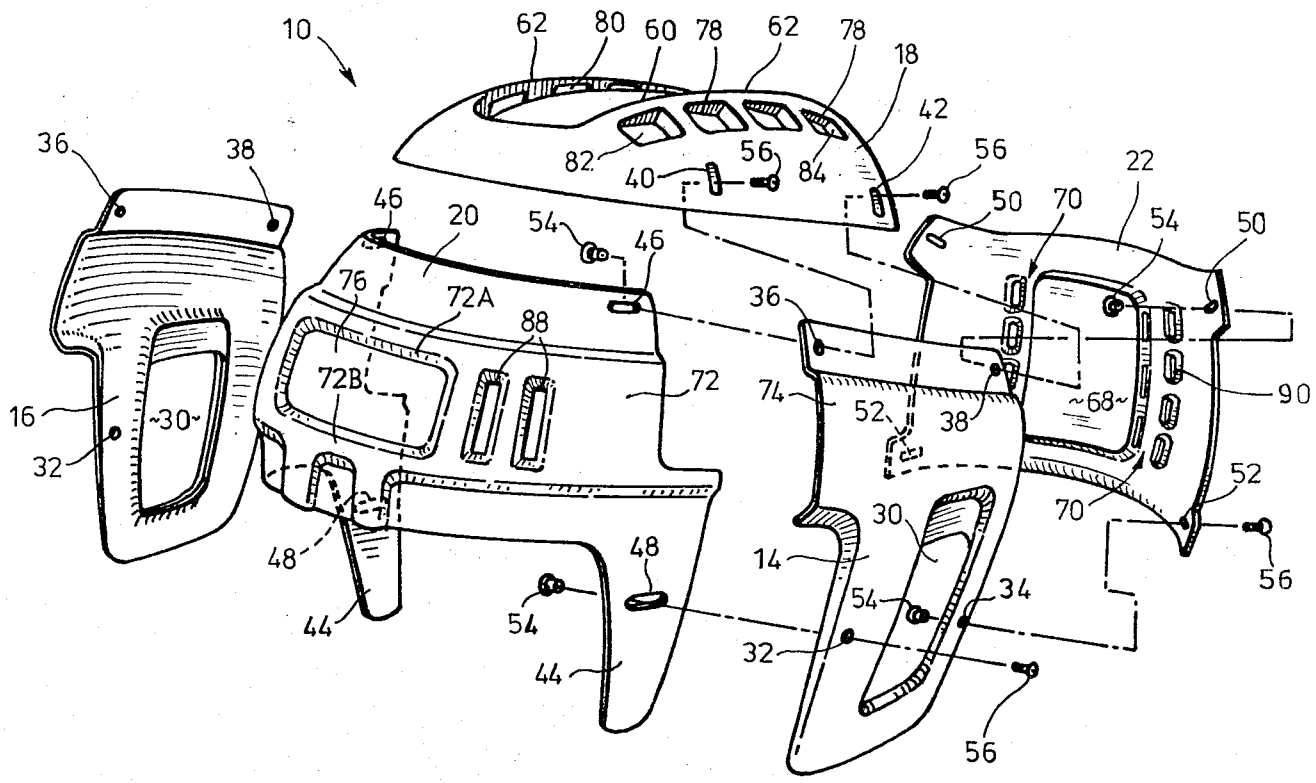
FIG. 1 is an exploded view showing the parts of the shell of the helmet, and showing generally their assembly one to another.
Figure 3:
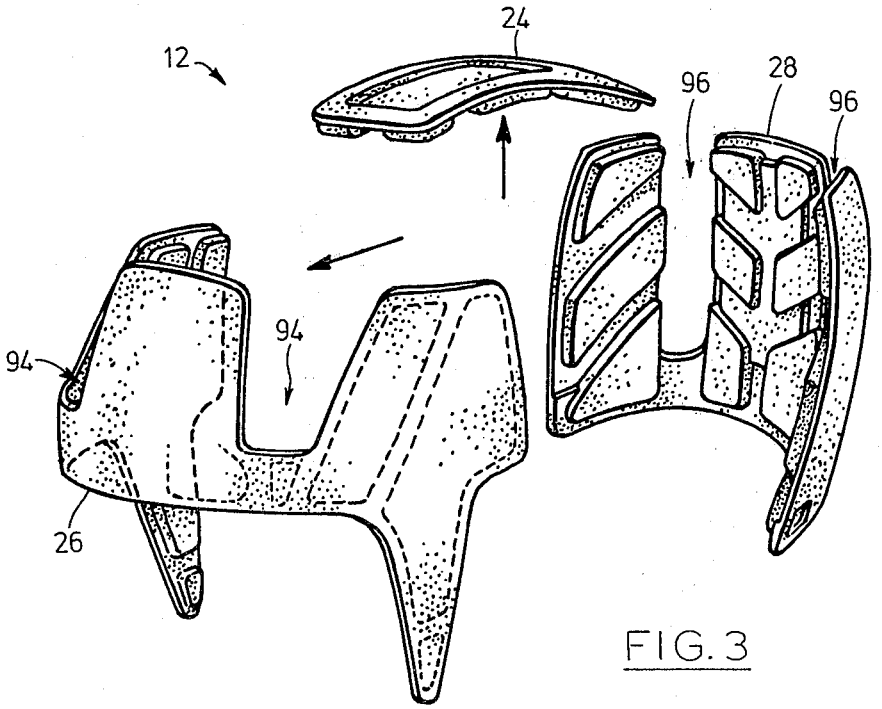
FIG. 3 is an exploded view showing the general relationship of the liner pieces one to another, but outside a helmet.
Figure 4:
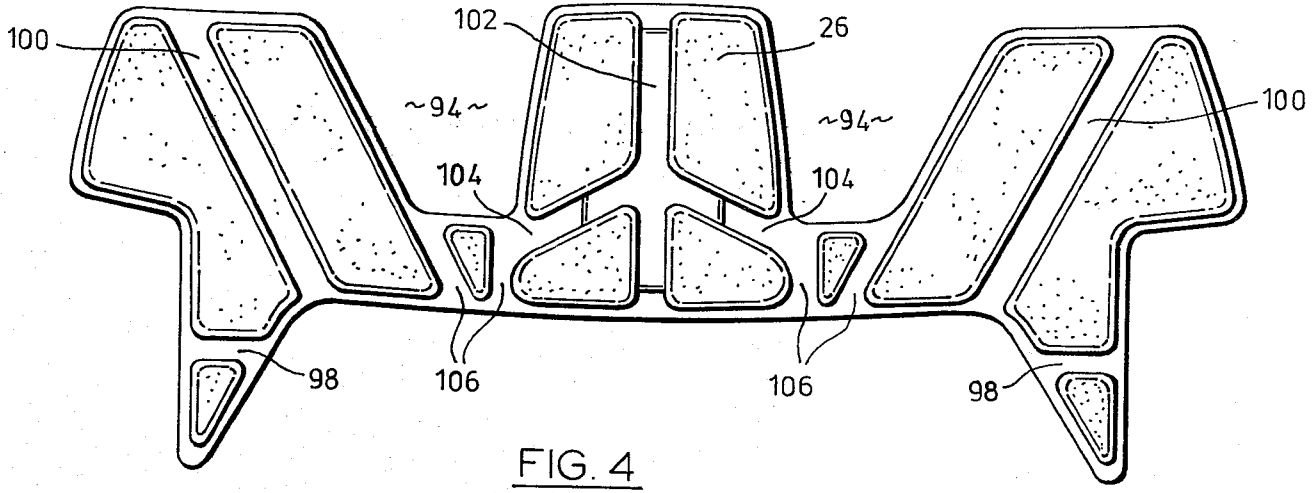
FIG. 4 is a view of the front liner piece in the direction of arrow 4 of FIG. 3, as it is molded flat.
Figure 5:
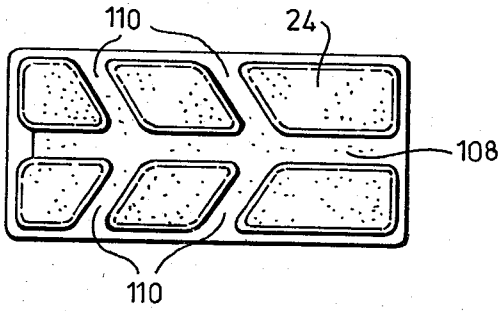
FIG. 5 is a view of the top liner piece in the direction of arrow 5 of FIG. 3, as it is molded flat.

As mentioned, the present invention provides a helmet, which has a shell shown generally at 10 in FIG. 1, and a liner which is shown generally at 12 in FIG. 3. The shell 10 comprises five pieces, namely: left and right side pieces 14 and 16; top piece 18; front piece 20; and back piece 22. The liner 12 comprises a top liner piece 24, a front liner piece 26 and a rear liner piece 28.

Referring specifically to FIG. 1, it is seen that the shell pieces comprise the following general characteristics. Each of the side pieces 14 and 16 is generally adapted to accommodate the left and right sides, respectively, of a human head. An opening 30 is provided in each side piece, for the ear; and as is discussed hereafter, the side pieces may have a somewhat different configuration. Each side piece 14 and 16 has respective forward, upper and rear portions. In the forward portions of each, a hole 32 is formed, and in the respective rear portions of each there is a hole 34. In the upper portions of each side piece 14 and 16 there is a front hole 36 and a rear hole 38. The purposes of the holes are discussed in greater detail hereafter.

The top piece 18 is generally downwardly concave, and has forward, rear and side portions, each of which has a lower portion. Obviously, the top piece 18 is generally adapted to accommodate at least the upper portion of a human head. In the front lower portions at each side of the top 18, there is a slot 40, only the left one of which is visible in FIG. 1. Likewise, in the rear portion of each side of the top 18, there is a similar slot 42. The orientation and purpose of the slots 40 and 42 is discussed in greater detail hereafter.

The front piece 20 is generally rearwardly curved, so that it is adapted to generally accommodate at least the forehead portion of a human head. However, generally the front piece 20 also includes a pair of downwardly extending legs 44, which serve to protect part of the jaw of the face. In any event, the front piece 20 has an upper portion and a rear portion at each side of the front piece. In the upper portion of the front piece 20, at each side thereof, there is formed a slot 46. In the lower rear portion of the front piece 20, at each side thereof, there is formed a slot 48. Once again, the purpose of slots 46 and 48 is discussed in greater detail hereafter.

The back piece 22 is generally forwardly curved, and is adapted to accommodate the rear portion of a human head. The back piece 22 has an upper portion, and a forward portion at each side thereof. There is a slot 50 formed in the upper portion of the back piece 22, at each side thereof; and there is a further slot 52 formed in the lower portion at each side of the back piece 22. As has been mentioned before, the particular purpose of the slots 50 and 52 is discussed in greater detail hereafter.

Likewise, a number of the other features evident in FIG. 1, with respect to each of the pieces of shell, such as the ventilation openings and the rib structures, are discussed in greater detail hereafter.

The assembly of the shell of the helmet according to the present invention, is such that the front and back pieces 20 and 22 are secured at their respective rear and forward portions to the respective forward and rear portions of each of the side pieces 14 and 16. Likewise, the top piece 18 is secured at least to both side pieces 14 and 16 at their respective upper portions.

It will be seen hereafter that, in either of the preferred embodiments, the top piece is secured not only to both side pieces, but also to the front and back pieces of the shell. However, it will also become evident hereafter that the adjustability of the helmet according to the present invention can also be provided by separate securement of the side pieces to the front and back pieces and to the top piece.

In general terms, the shell is assembled using a plurality of screws and mating nuts into which the screws are fitted. The dimensions of the nuts and screws are such that the nuts fit into recesses in the shell pieces, except for a head, and the screws thread into the nuts except for their heads. Thus, the heads of the nuts and screws are on each side of the helmet pieces where assembly takes place, but do not protrude more than a minimal amount from the surface at each place.

Clearly, the assembly of the front piece to the side pieces is by use of nuts 54 and screws 56, two of which are passed through a pair of openings in the rear portions of the front piece 20 at each side thereof, and a pair of openings at the front portions of the respective side pieces 14 and 16. At least one of each of the co-operating pairs of openings which accommodates the nut 54 and screw 56 combination, is a slot.

Generally, it is most convenient for the slots to be those slots 46 and 48 which are formed in the front piece 20 at each side thereof. The slots 46 and 48 are oriented generally in a front-to-back manner, with respect to a front-to-back axis of the helmet.

Likewise, the securement of the back piece 22 to the side pieces 14 and 16 is by way of co-operating openings, where at least one of the openings is a slot. In this case, the slots 50 and 52 co-operate with holes 38 and 34 in each of the side pieces 14 and 16 at each respective side of the back piece 22, to receive the nut and screw combination 54, 56 in each case. Also, as in the front piece 20, the slots 50 and 52 in the back piece are generally in a front-to-back orientation, with respect to a front-to-back axis of the helmet.

The securement of the top piece 18 to the side pieces 14 and 16 is also by way of nut and screw combinations 54, 56. In this case, at least one of the co-operating pairs of openings for each nut and screw combination 54, 56 by which securement of the top piece 18 to the side pieces 14 and 16 is achieved, is a slot which is oriented in a generally up-to-down manner with respect to a vertical axis of the helmet.

As mentioned, it is possible that the securement of the top 18 to the side pieces 14 and 16 may be by different fastenings means than the securement of the upper portions of the front and back pieces 22 to the respective upper portion of the side pieces 14 and 16. However, it is more convenient, and provides a stronger and more easily adjusted helmet structure, when all of the securement is at each corner of the helmet—i.e., at the left and right front corners and at the left and right rear corners. Thus, as indicated in FIG. 1, the screw 56 and nut 54 which secure the left front portion of the top piece 18 to the side piece 14, also secure the left rear upper portion of the front piece 20 to the side piece 14, by being passed through slot 40, hole 36 and slot 46, respectively. In like manner, the nut and screw combination 54, 56 at the left rear of the shell 10 which secures the top piece 18 to the side piece 14 also secures the back piece 22 in its upper portion to the upper portion of the side piece 14, by being passed through slot 42, hole 38 and slot 50, respectively.

It is evident that the slots 46 and 48 of the front piece 20, the slots 50 and 512 of back piece 22, and the slots 40 and 42 of the top piece 18, could all be formed with their respective front-to-back or up-to-down orientations in the side pieces 14 and 16. However, for purposes of adjustability, and especially considering that the adjustment of the front and back pieces and of the top piece are all substantially with respect to the side pieces, and moreover considering the strength of the materials especially where right angled slots may be formed as would otherwise be the case, it is more convenient and stronger to form the slots in the front, back and top pieces and to have only holes formed in the side pieces.

The assembly of the liner 12 into the shell 10 of a helmet according to the present invention may be by way of suitable adhesives, or by screw and nut combinations, or by rivets. In any event, the top liner piece 24 is assembled into the shell by being secured to the central underside of the top piece 18 of the shell. Likewise, the front liner piece 26 is secured to the inner surface of the front piece of the shell; and the back liner piece 28 is secured to the inside surface of the back piece 22 of the shell.

It is now evident that the assembly of a five piece helmet according to the present invention—assuming that, prior to the assembly, the liner pieces are secured to the respective top, front and back pieces of the shell—is very easily accomplished simply by passing eight nut and screw combinations through the appropriate slots and holes. Having regard to the general shape of the pieces of the shell, it will be noted that where each of the slots 46 and 48 is formed in the rear portions of the piece 20, those portions are curved rearwardly and outwardly. Likewise, where the slots 50 and 52 are formed in the forward portions of the back piece 22, those portions are curved forwardly and outwardly. Still further, where the slots 40 and 42 are formed in the lower portions of the top piece 18, those portions are curved downwardly and outwardly.

Having regard to the geometry of the slots as discussed above, and further when the front-to-back slots 46 and 48 are slightly sloped upwardly, then adjustment movement of the front piece 20 with respect to the side pieces 14 and 16 causes outward movement of the side pieces 14 and 16 at the same time that the front piece moves forward and slightly upwardly. Likewise, adjustment of the backpiece 22, when the slots 50 and 52 are sloped slightly downwardly, is such that rearward adjustment of the back piece 22 with respect to the side pieces 14 and 16, causes rearward and slightly downward movement of the back piece 22 at the same time that the side pieces 14 and 16 move outwardly with respect to one another.

Likewise, to accommodate the outward relative movement of the side pieces 14 and 16 with respect to one another when the top piece 18 moves upwardly, it is noted that the lower portions of the top piece 18 where the slots 40 and 42 are formed, are curved downwardly and outwardly.

Figure 7:
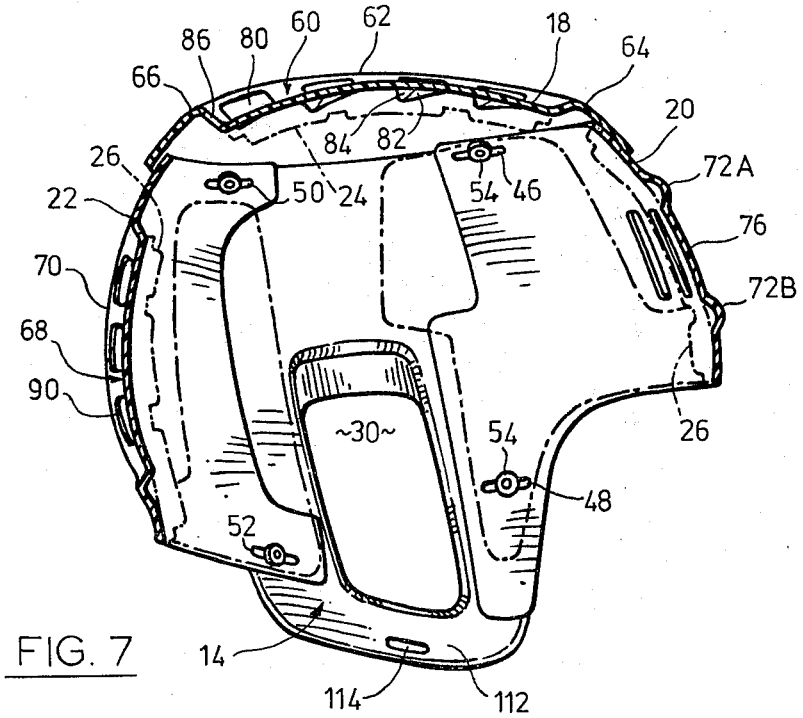
FIG. 7 is a cross-section of a helmet shell, such as that of FIG. 2, on the centre line thereof, with the relative positions of the liner pieces being shown in ghost lines.
Figure 8:
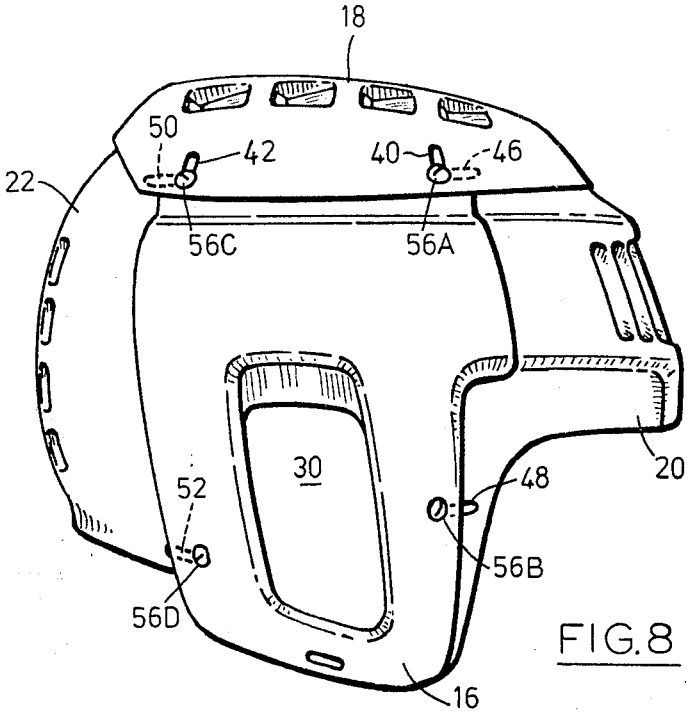
FIG. 8 is a side view of a helmet according to this invention, when fully expanded to its largest size; and, FIG. 9 is a side view of a helmet according to this invention when in its smaller size, with the outer outline of the same helmet when expanded to its largest size as in FIG. 8, being shown in ghost lines.
Figure 9:
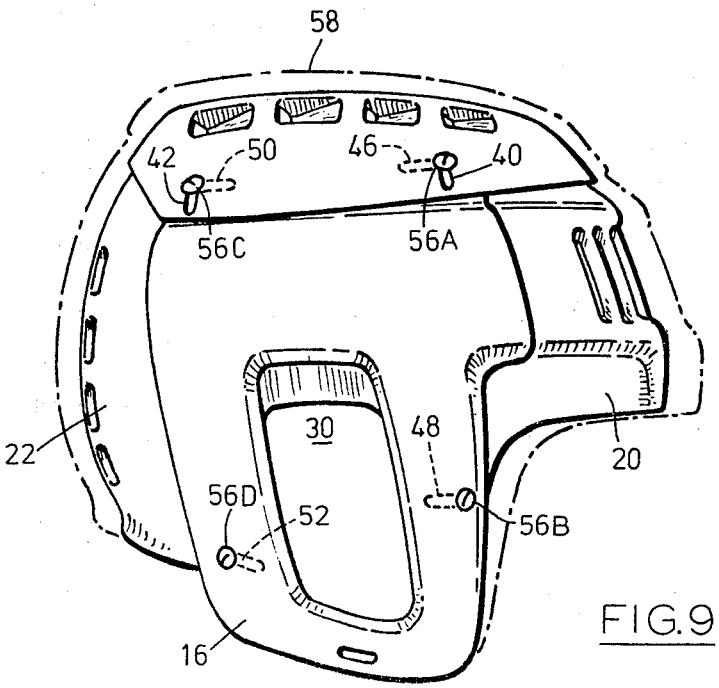

Thus, having regard generally to FIGS. 7, 8 and 9, the adjustment features of the helmet according to the present invention are clearly illustrated. Looking at FIG. 7, it is evident that there is quite sufficient overlap of the top piece 18 over each of the front and back pieces 20 and 22, and over the side pieces 14 (and 16, not shown).

FIGS. 8 and 9 clearly demonstrate the adjustability, at least lengthwise and heightwise, of helmets according to the present invention. In FIG. 8, it is noted that the screws designated 56A and 56C are at the extreme lower limits of the slots 40 and 42 in the top piece 18; the screws 56A and 56B are at the extreme rearmost limit of the slots 46 and 48 in the front piece 20; and the screws 56C and 56D are at the extreme frontmost limit of the slots 50 and 52 in the back piece 22.

However, when all of those positions are reversed as shown in FIG. 9, so that bottommost becomes topmost, frontmost becomes rearmost and rearmost becomes frontmost, then the adjustment from front-to-back and in height is demonstrated by the superimposition of the outline of the helmet from FIG. 8 by ghost lines 58 in FIG. 9.

It will be noted that there is a depression, designated generally at 60, formed in the central portion of the top piece 18. The depression 60 is formed in a front-to-back direction of the top piece 18, for less than the length of the top piece, so that a pair of ribs 62 is formed, one at each side of the depression 60. The ribs 62 are spaced and placed in such a position, and are sufficiently above the uppermost portion of the depression 60, such that either or both of the ribs 62 would come into contact with a flat surface, such as rink boards or the ice, before the depression 60. The ribs provide additional stiffening and, due to their springiness, they also provide some energy absorption as well as serving the purpose to distribute the force of impact away from the impact point.

Moreover, because of the nature of the depression 60 formed in the top piece 18, there are additional ribs 64 and 66 which are formed in the front and rear portions of the top piece 18. (See especially FIG. 7.) Thus, the strength of the helmet due to the ribs, their ability to absorb impact due to the springiness of the rib structure and the material of which the shell is formed, and their ability to distribute energy, is enhanced.

In the same manner, there is formed in the central portion of the back piece 22, a depression generally indicated at 68. The depression 68 is generally in an up-to-down direction, and is less than the height of the back piece 22. A pair of ribs 70 is thus formed at each side of the depression 68; and likewise, the ribs 70 provide additional strength, force distribution and energy absorption characteristics to the helmet.

Moreover, it is evident from FIG. 7 that there are two layers of material where the top piece 18 overlaps the front and back pieces 20 and 22, or the side pieces 14 and 16, and three layers in at least some of the regions surrounding screws 56A and 56C as designated in FIG. 8, at both sides of the helmet. Additional rigidity is, therefore, provided to the helmet in all of those regions.

Figure 2:
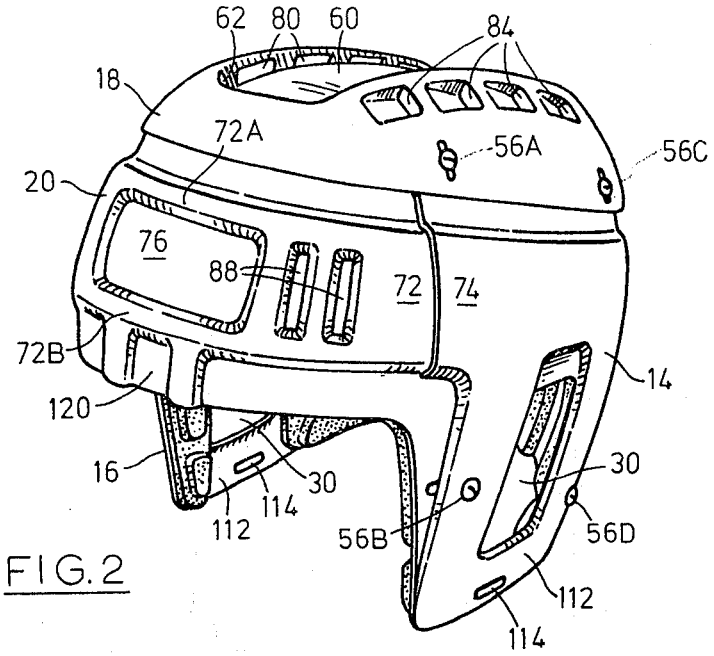
FIG. 2 is a perspective view of an assembled helmet, as seen from an upper front left quarter.

Still further, there is an additional rib designated at 72, which is an upstanding rib formed horizontally in the front piece 20. Moreover, the rib 72 extends at 74 into each of the side pieces 14 and 16, at the same height with respect to the top piece 18, when the helmet shell is assembled. (See, for example, FIGS. 2 and 6.)

In the central front portion of the rib 72, there is a depression 76 formed, whereby a pair of ribs 72A and 72B are formed as indicated in FIG. 7. The purpose for the depression 76 is to carry the manufacturers logo, or a team logo or other decoration as may be desired.

It will also be noted that, in the top piece 18, there are a plurality of vent openings 78 along each outside portion of each of the ribs 62, and a further plurality of vent openings 80 along each inside portion of each of the ribs 62. The vent openings 78 are louvered, that is to say that each of the vent openings 78 has a ramp 82 which extends rearwardly and somewhat inwardly with respect to the general direction of the outer periphery of rib 62 at each vent opening, and which terminates in an opening 84 which is disposed in such a manner that a substantial area of each opening 84 faces forward. In other words, the vent openings 78 are louvered, so as to enhance and promote air flow inwardly towards the interior of the helmet as the wearer is skating or otherwise moving forward. Likewise, there is a further pair of vent openings 86 formed in the upstanding rib portion which defines the rearmost end of the depression 60 formed in the top piece 18.

There are also several ventilation openings formed in the front piece 20, as at 88, on either side of the depression 76. They also serve to promote and enhance airflow to the interior of the helmet, especially as the person wearing the helmet may be moving forward.

A plurality of vent openings is formed in the back piece 22. They include vent openings 90 formed on the outer sides of each of the ribs 70, and vent openings 92 formed on the inner sides of each of the ribs 70. Thus, when the person wearing the helmet is skating forward, air flow from within the interior of the helmet through the vent openings 90 and 92 will occur. Likewise, if the person is moving backwards—for example, a defence player—the air flow into his helmet will at that time reverse, and he is still assured of air flow into the helmet through the vent openings 90 and 92.

Moreover, air flow from within the helmet to the exterior thereof may occur, especially when the player is not moving, by flowing out through any of the openings 80, 84 or 86 in the top piece 18 of the helmet.

In general, the edges of each of the vent openings, particularly the vent openings 80, 88, 90 and 92 are reinforced by having inwardly extending beaded edges.

To further enhance and promote air flow in the helmet, the liner pieces 24, 26 and 28 may be formed with indentations, serrated portions in the periphery, and grooves. For example, the front portion 26 is indented at both sides at 94 to accommodate the vent openings 88 in the front piece 20. Likewise, the back liner piece 28 is intended at 96 on both. Likewise, the back liner piece 28 is indented at 96 on both sides to accommodate the vent openings 90 and 92 on both sides of the ribs 70. Moreover, a number of grooves are formed in the front liner piece 26, as at 98, 100, 102, 104 and 106, all so as to permit the flow of air past the liner piece 26 from around the edges thereof which are exposed around the face of the wearer, as well as to or from the vent openings 88. In the same manner, grooves are formed in the top liner piece 24 at 108 and 110 to promote air flow in a direction toward or from vent openings 80 and 84 in the top piece 18, especially depending upon the direction of movement of the player.

Not only does the provision of a plurality of vent openings as described above better ensure that the head of the person wearing the helmet will remain relatively cool, but when the vent openings are positioned substantially as described there is a promotion of the flow of cooling air through the interior of the helmet or from the interior. Moreover, the overall weight of the helmet is somewhat less, but the protective effectiveness of the helmet is in no way compromised because of the placement of the vent openings in their positions on either side of ribs 62 or 70, or within the rib 72. Further ventilation around the ear is promoted, for example, by virtue of the channels or grooves 98 and 100 which are formed in the front liner piece 26.

Figure 6:
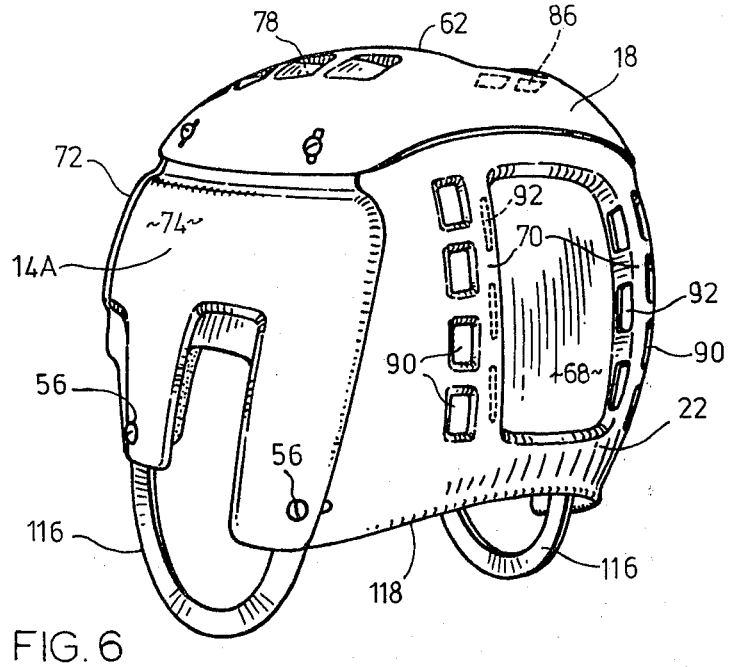
FIG. 6 is a view of a helmet from a rear left quarter, showing a different ear sling.

The helmet of the present invention may have a cross-bar 112 integrally formed in the bottom portions in each of the side pieces 14 and 16, in which slots 114 may be formed for carrying a suitable chin strap or other harness by which the helmet may be fastened to the head of the wearer. Alternatively, as shown in FIG. 6, the lower portion of each of the side pieces 14A and 16A (not shown) may have a separate ear sling 116 secured to the side pieces by the same nut and bolt combinations 54, 56 that secure the lower portions of the front and back pieces 20 and 22 to the side pieces 14A and 16A. A suitable chin strap or other harness piece can be secured to the ear sling 116.

One advantage of the cross-bar 112 is that is provides additional protection for the jaw, especially the jaw hinge. However, the incorporation of the cross-bar 112 may tend to make the helmet very slightly heavier.

Partially for reasons of aesthetics, and partially for reasons of safety, especially around the base of the back piece 22 at the nape of the neck, certain of the outer edges of the pieces of the shell may have beaded edges formed in them. For example, the lower edge 118 of the back piece 22 may be beaded, as well as around the edge 118 of the back piece 22 may be beaded, as well as around the edge of the top piece 18 and around the edges of the side pieces 14 and 16, and the lower edge of the front piece 20 and 120. Thus, where the edges of the helmet may come into direct contact with the skin of the person wearing the helmet, as at the face and back of the neck, or around the ears, the beaded edge assures that the edge will not be sharp. Moreover, the beaded edge around the top piece 18 provides additional rigidity.

In general, all of the pieces of the helmet according to the present invention may be injection molded. It is possible, however, that the liner pieces may be die cut, in which case they may not have the grooves and channels as discussed and illustrated; moreover, the helmet shell pieces may be vacuum formed.

However, production of the helmet pieces in quantity is much more easily controlled, and indeed is less expensive, when the pieces are injection molded. They may be formed of high impact polyethylene, polycarbonate, polypropylene, and co-polymers of polyethylene and polypropylene; and if vacuum formed, may be from polyethylene or polyvinyl chloride. Further, particularly for such purposes as motorcycle rider protection, the helmet pieces may be formed of moulded fibreglass. The liner pieces are generally made of foamed polyethylene or other suitable foam materials. The material of the liner should, in any event, be capable of absorbing energy instead of storing energy as would foamed rubber.

When, as is usual, the pieces of the shell are injection molded, the costs of the molds and therefore the cost of production may be significantly lower than for a two piece helmet. Each piece may be molded in a standard injection mold without the necessity for sliders to form undercuts and the like, and because each piece is relatively shallow as compared to the height of a helmet shell which may be formed in a single piece (see, for example, O'CONNOR U.S. Pat. No. 3,783,450, referred to above), the amount of steel required to form the injection molding cavity is less. Thus, it is possible that the helmet of the present invention may be provided at a more reasonable price than helmets having a single piece shell or even a two piece shell.

There has been described a helmet which is primarily intended for use as a hockey helmet but which may have other uses and purposes. The helmet provides exceptional protection for the entire head of the wearer, including the forehead and temple regions, the crown of the skull, and the back of the head down to the nape of the neck. The sides of the head and the ears are protected as well. Moreover, the helmet of the present invention provides adequate ventilation to keep the head of the player cool, or to promote cooling, all to a greater extent than prior helmets such as those discussed above.

More especially, a helmet according to the present invention provides adjustability as to size, in length, in height and in width. Further, the helmet may provide such adjustability that as the back of the helmet is adjusted with respect to the sides, it moves slightly downwardly, and the front of the helmet as it is adjusted with respect to the sides may move slightly upwardly. This takes into account, therefore, the fact that the head is substantially elliptoid and that bigger heads are wider and higher, with somewhat higher foreheads, and which require lower protection across the back of the head. Moreover, as noted, the wearer of a helmet according to the present invention may move some of the shell pieces without moving other shell pieces, so as to accommodate somewhat peculiar shaped heads or large bumps on the skull, where prior two piece helmets of the sort described before may otherwise pinch or create severe discomfort for the wearer.

When helmets of the present invention, and indeed any hockey helmet, are worn by youngsters in minor leagues, they are required also to wear face masks. Helmets of the present invention provide very positive face mask securing edges and positions. Also, because of the provision of the cross-bar, below the ear in the lower portion of the side pieces of helmets according to the present invention, modified face masks can be provided with excellent protection for the mouth and jaw, but without weighing as much as previous helmet/mask combinations.

It is evident that other modifications may be made to the design of helmets according to the present invention, other securement and adjustment methods than those specifically described with respect to preferred embodiments may be used, and other ventilation openings may be provided with different rib or louvre configurations, but without departing from the spirit and scope of the appended claims.

What is claimed is:

1. A helmet adapted to be placed over a human head, and having a shell and a liner, where said shell comprises:

a pair of side pieces each having respective forward, upper and rear portions, and being adapted to generally accommodate each side, respectively, of a human head;

a top piece being generally downwardly concave and having forward, rear and side portions, each of which has a lower portion; said top piece being adapted to generally accommodate at least the upper portion of the human head;

a front piece being generally rearwardly curved and adapted to generally accommodate at least the forehead portion of a human head; said front piece having an upper portion, and a rear portion at each side thereof;

and a back piece being generally forwardly curved and adapted to generally accommodate the rear portion of a human head; said back piece having an upper portion, and a forward portion at each side thereof;

said front and back pieces being each secured at their respective rear and forward portions to the respective forward and rear portions of each of said pair of side pieces; and said top piece being secured at least to both side pieces at their respective upper portions.

2. The helmet of claim 1, where said helmet is adjustable to accommodate more than one size of human head in front-to-back length, height, and width; wherein:

the securement of said front piece to said side pieces is by respective fastening means passed through a pair of openings in the rear portions of said front piece and a corresponding pair of openings in the forward portion of each of said side pieces, at least one of each co-operating pair of openings which accommodates a single fastening means being a slot which is oriented in a generally front-to-back manner with respect to a front-to-back axis of said helmet;

the securement of said back piece to said side pieces is by respective fastening means passed through a pair of openings in the forward portions of said back piece and a corresponding pair of openings in the rear portion of each of said side pieces, at least one of each co-operating pair of openings which accommodates a single fastening means being a slot which is oriented in a generally front-to-back manner with respect to a front-to-back axis of said helmet;

and the securement of said top piece to said respective upper portions of said side pieces is by respective fastening means passed through a pair of openings in each respective upper portion of each side and through a corresponding pair of openings in each side portion of said top piece in the bottom portion thereof, at least one of each co-operating pair of openings which accommodates a single fastening means being a slot which is oriented in a generally up-to-down manner with respect to a vertical axis of said helmet.

3. The helmet of claim 2, where said top piece is further secured to said front and back pieces in the upper portions only of their respective rear and forward portions.

4. The helmet of claim 3, where the securement of said top piece to said front piece is by the same fastening means that secure the upper portions of the rear portions of said front piece to the respective forward portions of the upper portions of said side pieces;

and the securement of said top piece to said back piece is by the same fastening means that secure the upper portions of the forward portions of said back piece to the respective rear portions of the upper portions of said side pieces.

5. The helmet of claim 4, where said front-to-back slots are in said front and back pieces, and said up-to-down slots are in said top piece.

6. The helmet of claim 5, where said liner comprises a top liner piece, a front liner piece, and a back liner piece;

said top liner piece being adapted to be fitted into said top piece of said shell;

said front liner piece being adapted to be fitted into said front piece of said shell;

and said back liner piece being adapted to be fitted into said back piece of said shell.

7. The helmet of claim 6, where said front and back liner pieces each overlap portions of said side pieces.

8. The helmet of claim 6, where said front-to-back slots in said front piece are slightly sloped so that adjustment movement of said front piece with respect to said side pieces is forward and slightly upward; and said front-to-back slots in said back piece are slightly sloped so that adjustment movement of said back piece with respect to said side pieces is rearward and slightly downward.

9. The helmet of claim 8, where said side pieces each overlap respective portions of said front and back pieces; and said top piece overlaps respective portions of said front, back and side pieces.

10. The helmet of claim 9, where a depression is formed in the central portion of said top piece, in a front-to-back direction for less than the length thereof, so as to form a pair of ribs, one at each side of said depression.

11. The helmet of claim 10, where a plurality of vent openings is formed along each side of each said pair of ribs in said top piece.

12. The helmet of claim 11, where at least the vent openings along the outer sides of said pair of ribs are louvered inwardly.

13. The helmet of claim 12, where the rearmost end of said depression is defined by a generally upwardly extending rib portion in which at least one vent opening is formed.

14. The helmet of claim 9, where a depression is formed in the central portion of said back piece, in an up-to-down direction for less than the height thereof, so as to form a pair of ribs, one at each side of said depression.

15. The helmet of claim 14, where a plurality of vent openings is formed along each side of said pair of ribs in said back piece.

16. The helmet of claim 9, where at least one vent opening is formed at each side of said front piece.

17. The helmet of claim 12, 15 or 16, where said liner has formed in it grooves to guide the flow of air within the interior of said helmet in the direction of said vent openings.

18. The helmet of claim 13, where said liner has formed in it grooves to guide the flow of air within the interior of said helmet in the direction of said vent openings.

19. The helmet of claim 12, 15 or 16, where each of side pieces has an integrally formed cross-bar at the lower portion thereof, adapted to fit below the ear on each respective side.

20. The helmet of claim 12, 15 or 16, where each of said side pieces has a separate ear sling secured thereto at the lower portion thereof, adapted to fit below the ear on each respective side.

21. The helmet of claim 12, 15 or 16, where an upstanding rib is formed horizontally in said front piece, and in each of said side pieces at the same height with respect to said top piece, when assembled.

22. The helmet of claim 11, 12 or 13, where a rib is formed at the front and rear extremities of said depression.

23. The helmet of claim 12, 15 or 16, where each of said vent openings is reinforced around its edges by inwardly extending ribs.

24. The helmet of claim 12, 15 or 16, where said shell pieces are each injection molded of a material chosen from the group consisting of polyethylene, polycarbonate, polypropylene, and co-polymers of polyethylene and polypropylene.

25. The helmet of claim 12, 15 or 16, where said shell pieces are each formed by vacuum molding and trimming a material chosen from the group consisting of polyethylene and polyvinyl chloride.

26. The helmet of claim 12, 15 or 16, where the rear portions of said front piece where said front-to-rear slots are formed, are curved rearwardly and outwardly; the forward portions of said back piece where said front-to-rear slots are formed, are curved forwardly and outwardly; and the lower portions of said top piece where said up-to-down slots are formed, are curved downwardly and outwardly.

* * * * *